US006779442B2

(12) United States Patent
Strasser

(10) Patent No.: US 6,779,442 B2
(45) Date of Patent: Aug. 24, 2004

(54) ROTARY PRESS TO PRINT PATTERNS ON A SUPPORT STRIP

(75) Inventor: Georg Strasser, Kradolf (CH)

(73) Assignee: Bobst SA (CH)

( * ) Notice: Subject to any disclaimer, the term of this patent is extended or adjusted under 35 U.S.C. 154(b) by 0 days.

(21) Appl. No.: 10/644,104

(22) Filed: Aug. 19, 2003

(65) Prior Publication Data

US 2004/0031405 A1 Feb. 19, 2004

(30) Foreign Application Priority Data

Aug. 19, 2002 (CH) ..... 1420/02

(51) Int. Cl.[7] ..... B41D 7/00; B41C 1/06; B41L 13/08; B41F 5/00

(52) U.S. Cl. ..... 101/33; 101/23; 101/34; 101/35; 101/122; 101/216

(58) Field of Search ..... 101/33, 23, 34, 101/35, 122, 216; 156/234, 552, 351, 475

(56) References Cited

U.S. PATENT DOCUMENTS 2,981,432 A * 4/1961 Flood ..... 156/475
4,488,925 A * 12/1984 Craig et al. ..... 156/351
5,618,378 A * 4/1997 Cahill ..... 156/552
6,082,259 A * 7/2000 Siegenthaler et al. ..... 101/227
6,193,640 B1 * 2/2001 Weis ..... 493/346
6,251,225 B1 * 6/2001 Ruf et al. ..... 162/198
6,263,790 B1 * 7/2001 Wyssmann et al. ..... 101/35
6,302,016 B1 * 10/2001 Fausto et al. ..... 101/118
6,387,201 B1 * 5/2002 Stuart et al. ..... 156/234
6,595,130 B2 * 7/2003 Uehara ..... 101/216
6,694,872 B1 * 2/2004 LaBelle et al. ..... 101/23

* cited by examiner

*Primary Examiner*—Daniel J. Colilla
*Assistant Examiner*—Wasseem H. Hamdan
(74) *Attorney, Agent, or Firm*—Ostrolenk, Faber, Gerb & Soffen, LLP

(57) ABSTRACT

A rotary press to print patterns on support strips includes a drive for driving the support strip lengthwise at a defined speed; a supply for strip material of the patterns to be applied to the strip located laterally to the lengthwise drive and direction of the support strip; a transfer device for transferring the patterns from the strip material to defined locations on the strip; another drive for driving the strip material through the transfer device intermittently with the defined speed of the support strip. Strip material reorientation elements are arranged along the path of the strip material to modify its direction from transverse to the support strip to the same direction thereof and to deliver the support strip material and the support strip to a transfer device where transfer occurs. Various length and speed controls associated with the strip material deliver the same to the transfer section at a selected speed. A device joins successive reels of the strip material, preferably without interruption of the delivery of strip material to the transfer device, preferably by use of storage disposals for the strip material.

19 Claims, 9 Drawing Sheets

ROTARY PRESS TO PRINT PATTERNS ON A SUPPORT STRIP

BACKGROUND OF THE INVENTION

The present invention relates to a rotary press to lay patterns on a support strip, including means to longitudinally drive the support strip at a defined speed, means to supply at least one strip material with the patterns, means to transfer these patterns from the strip material to determined spots on the support strip, means to intermittently drive the strip material through the transfer means at the defined speed of the support strip.

A device has already been disclosed in patent EP 441 596 for the transfer, from a strip material of material to be laid, of printed images of this material in defined locations of a support strip, which is being driven at a constant speed. In such a device, it is clear that the length of the consumed laid material only represents a fraction of the strip material. The strip material to be laid is made up of a laminated material, which is expensive. This is the reason why displacement means have been suggested in the EP document, comprising means to reverse the lengthwise movement of the strip material to be laid, these displacement means for displacement in the opposite direction being respectively arranged up and downstream of the displacement means allowing the image transfer from the strip material to the support strip, in order to reduce the space dividing two successive images on the strip material, so as to maximize the consumption of the strip material and eliminate waste.

In such a device, the strip material to be laid and the support strip have two parallel longitudinal paths in order to allow the transfer means to press them one against each other with adequate pressure, temperature and time in order to allow the image transfer. The supply means of the strip material are necessarily superimposed on the support strip that is bound to go through several successive working stations located along an installation path that can reach 10 meters long, so that the strip material has to be supplied from above the working stations, which makes the changing of paper reels work laborious and hard.

SUMMARY OF THE INVENTION

The object of the present invention is to cope, at least partly, with the aforesaid disadvantages.

To this aim, the present invention refers to a rotary press to print patterns on a support strip of the aforesaid type. The rotary press for printing patterns on a support strip includes a driveable support to drive the support strip lengthwise at a selected speed. A supply disposed laterally of the support strip and laterally of the lengthwise direction of the support strip supplies at least one and often a plurality of strip materials having a pattern thereon. There is a transfer device that is positioned for bringing the support strip and the strip material together and for transferring the patterns to the support strip at defined locations. An intermittent drive is operable on the strip material to drive the strip material through the transfer intermittently. The intermittent drive for driving the strip material from the supply drives it initially in a direction transverse to the lengthwise direction of the support strip. There are strip material direction devices positioned after the supply for modifying the direction of the material strip after the material strip leaves the supply and before the material strip passes to the transfer device. The direction is modified from the supply direction which is transverse to the lengthwise drive direction of the support strip to the transfer direction that is parallel to that lengthwise direction. There is at the supply a constant drive for driving the strip material at a constant speed. There is a storage disposal for the strip material between the constant drive and the intermittent drive and the storage disposal stores the strip material before it is driven by the intermittent drive. The intermittent drive may include at least a drive roller and a free rotation roller engageable with it or a plurality of those in series. There is a junction device for connecting the trailing end of one reel with the leading end of the next reel of the strip material. There is a reserve for the material so that the junction device operation does not interfere with the feeding of the strip material. The junction device includes a support for two reels, the reel being dispensed from and a reel in reserve, rotates the support of the junction device to bring the next reel into position and includes supports and guides that move the ends of the strips to form a continuous strip to be fed.

Access to the supply stations of strip material to be laid on the support strip is easy. Taking into account the lateral position of this supply station in relation to the support strip, the supply station can include several units that can be superimposed, while they stay accessible from the floor in order to be easily reloaded. Such an arrangement allows savings in the filled surface while multiplying the number of printed patterns.

This arrangement also favors possible automatic run through without any stop in the production, allowing for this purpose the integration of a strip material accumulator that can be filled with a reserve as the strip material supplying reel becomes empty. This strip material reserve can thus be used during the joining operation between the end of one strip material and the beginning of the following one.

Other characteristics of the present invention will emerge along the following description that will be achieved in relation with the enclosed drawings that illustrate, schematically and as an example, one type of execution of the rotary press to print patterns on a support strip, subject of the present invention.

DESCRIPTION OF PREFERRED EMBODIMENTS

Figure 1:
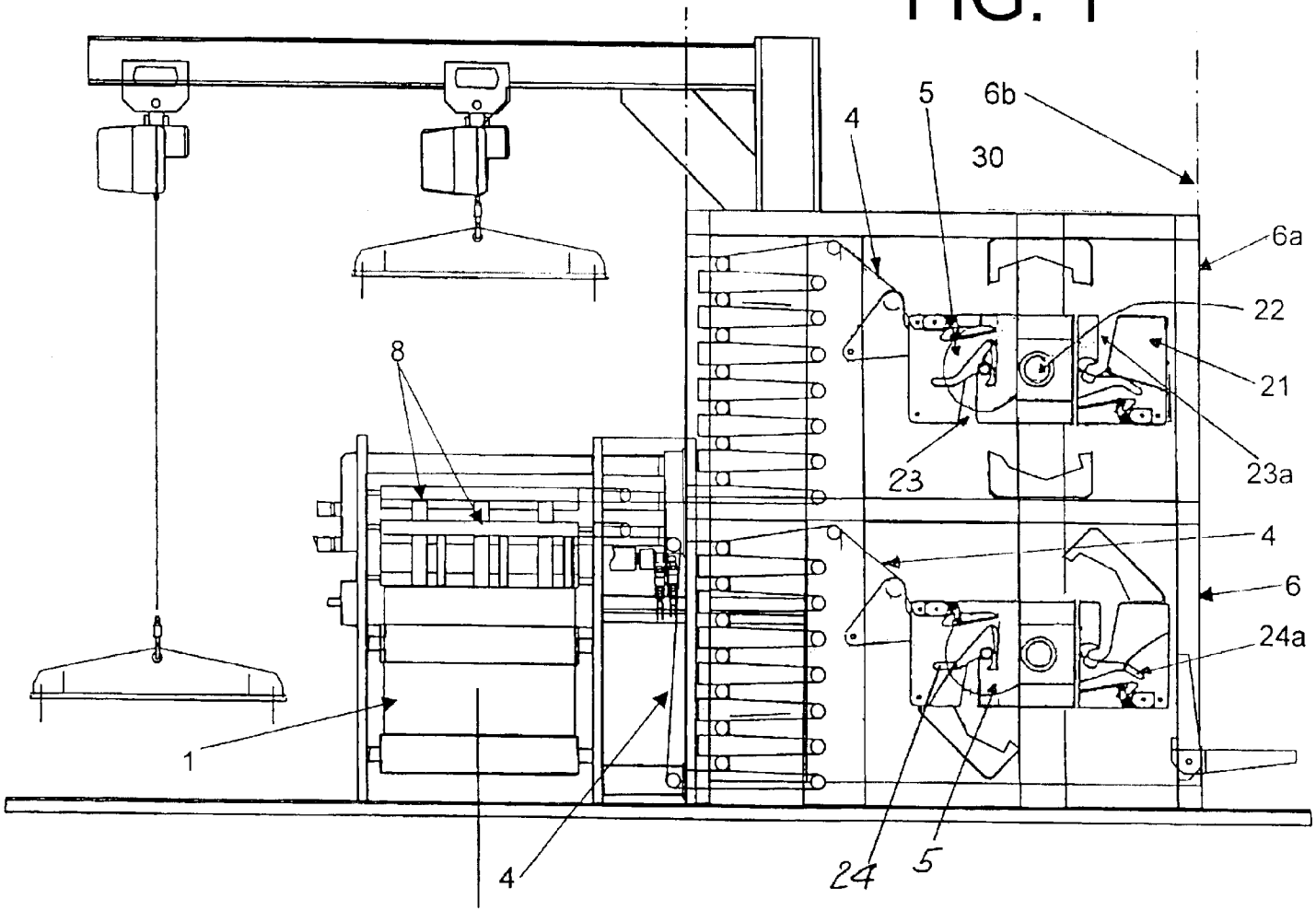
FIG. 1 is an elevation view of this type of execution, transversely to the moving direction of the support strip on which are laid the printed patterns.
Figure 2:
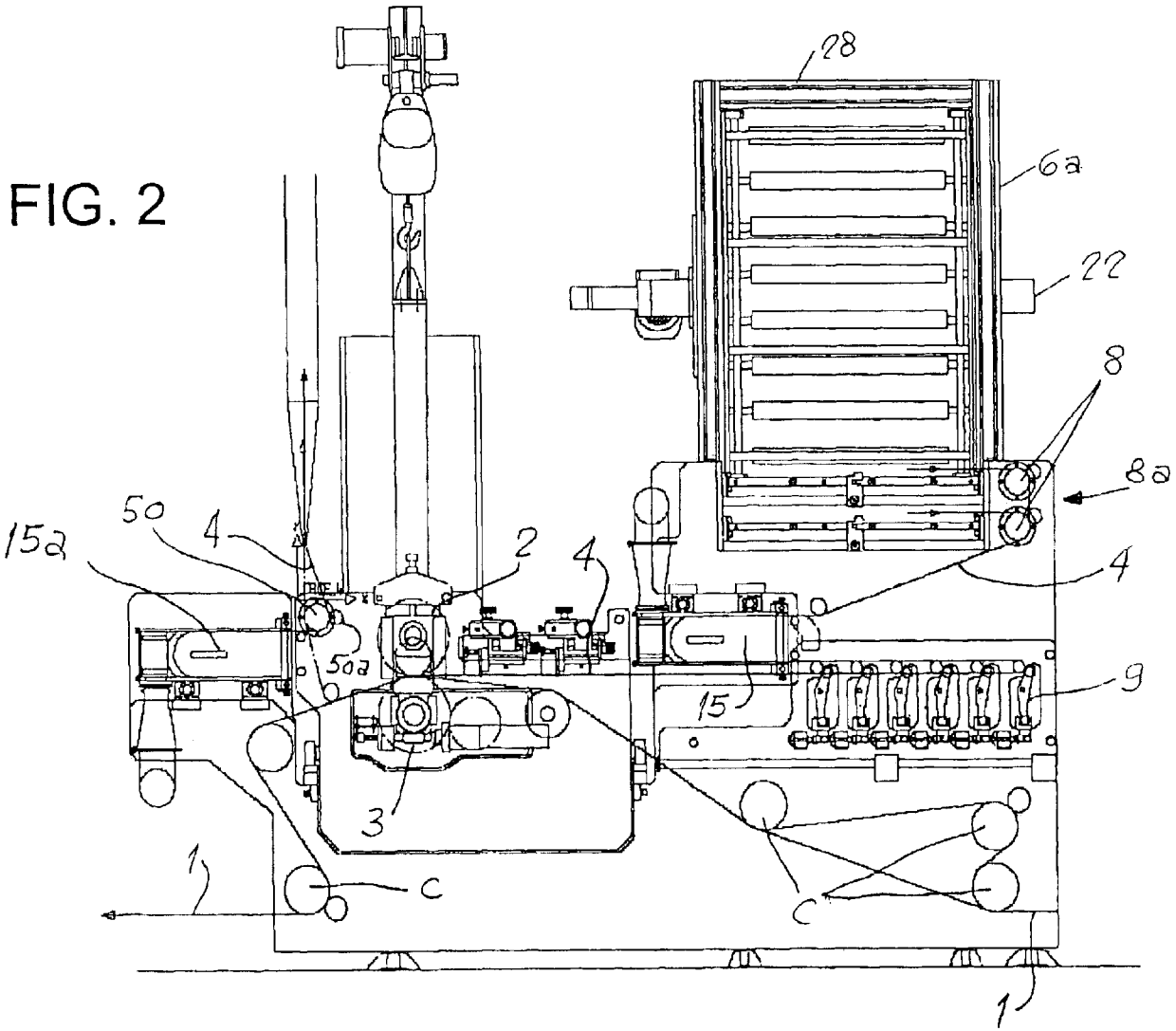
FIG. 2 is an lateral elevation view of FIG. 1.
Figure 3:
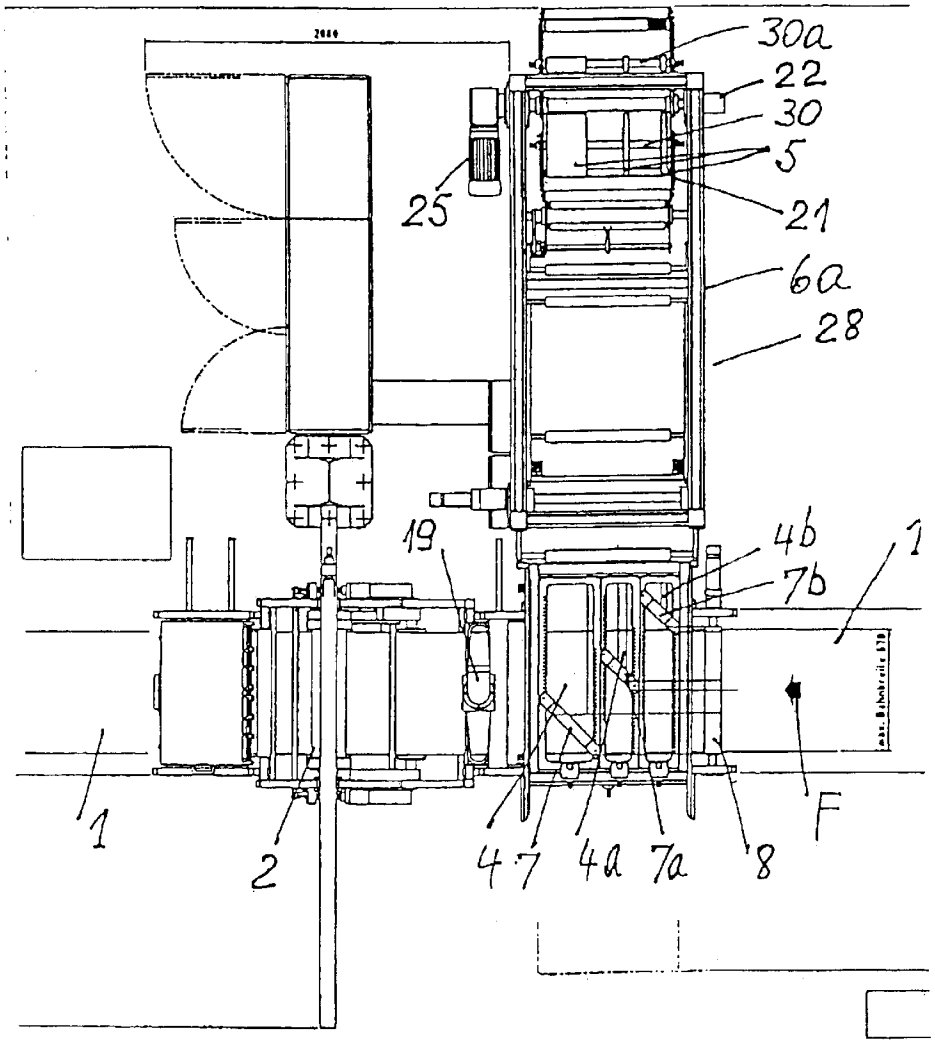
FIG. 3 is a view from above FIG. 2.

The rotary press illustrated by FIGS. 1 to 3 is more particularly, even if not exclusively, meant for being inserted in an impression line on a support strip. This impression line can be a line for printing, cutting and ribbing of cardboard articles, in particular a production line of rough sketches of cardboard boxes meant in following stages to be formed into boxes by folding along the ribs provided on the folding zones.

This rotary press is then set in the direction of the lengthwise movement of a support strip 1 that moves in the direction of arrow F (FIG. 3) and, which is driven and directed according to a defined path by a succession of driving and directing cylinders C (FIG. 2), not only through the rotary press but all along the impression line. The support strip 1 is brought between two cylinders 2, 3 (FIG. 2) of a transfer mechanism, that are set transversely to the lengthwise direction of the support strip 1, which will be explained below.

The patterns material to be laid on defined locations of the support strip 1, which material may in particular be a metallic film, is rigidly locked with a strip material 4. It might be that several strip materials 4 hold similar films or different materials and/or colors, according to the color of the patterns to be laid on the support strip 1. These strip materials 4 are made up of compound materials generally including a polyester strip, a wax separating layer, a color varnish made up of a resin, an aluminium layer and finally an adhesive layer.

These material strips 4 are stocked on supply reels 5, one in use and one alternately in reserve, and the reels are disposed in one or in several superimposed supply units 6, 6*a*, 6*b* (FIG. 1), which, in this example, may be three. As shown on FIGS. 1 and 3, the strip materials 4 moving out of the supply reels 5 come laterally to the support strip 1.

As shown in FIG. 3, three strip materials 4, 4*a*, 4*b* are then driven toward support strip 1 perpendicularly to the length of strip 1. Three guides 7, 7*a*, 7*b* comprised of rods are set upon the bisectrix of the angle formed between the portions at 45° of the strip materials 4, 4*a*, 4*b*, located upstream of the guides 7, 7*a*, 7*b* and the portions of the strip located downstream of these guides. The direction of the latter portions of the strip is parallel to the direction of the support strip 1. Each of these material strip 4, 4*a*, 4*b* is turned and wrapped around its respective guide 7, 7*a*, 7*b* by 180°, so that the positions of the inferior and superior faces of each of the strip material is reversed, and in addition the directions of these strip materials 4, 4*a*, 4*b* move 90° to be in line with the direction of the support strip 1.

In the illustrated example, these strip materials 4, 4*a*, 4*b* are driven from guides 7, 7*a*, 7*b* in an opposite direction from support strip 1. One or several transverse driving rollers 8 are used to again turn the strip material 4, 4*a*, 4*b* by 180° in order to bring them back in the direction F of the support strip 1. These rollers 8, related to the impression cylinder 8*a*, form driving disposals or reserves for material strips 4, 4*a*, 4*b* at a constant speed. Each transverse roller 8 can rotate at a different speed from the other transverse rollers, according to the consumption of each strip material 4, 4*a*, 4*b* to be laid, which can vary in relation to the size and spacing of the respective patterns.

Figure 4:
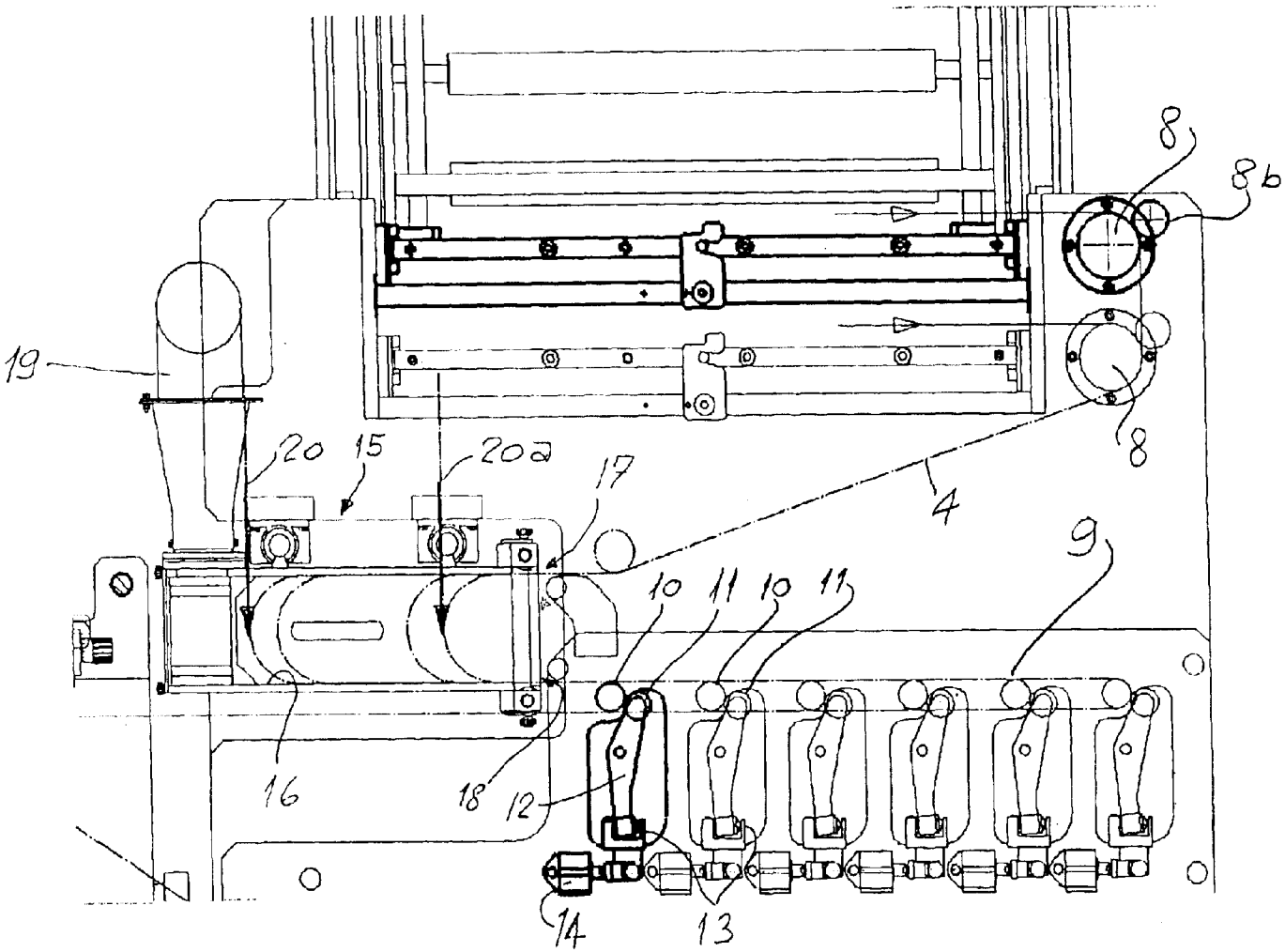
FIG. 4 is an enlarged and simplified partial view of FIG. 2.

A succession of intermittent driving disposal 9 (FIGS. 2 and 4) is set downstream of the transverse driving roller 8. As illustrated in FIG. 4, each intermittent driving disposal 9 includes a driving roller 10 turning at a modulated speed, around each of which the strip materials 4, 4*a*, 4*b* turn 180°, and a counter cylinder 11 rigidly locked with a rocking 12 lever which is in turn in gear with a cross piece 13 driven by two winches 14. Depending on the rocking position of the cover 12, the strip material 4, 4*a*, 4*b* is pressed between the driving roller 10 and the counter cylinder 11, so that it is driven at the driving roller speed 10. During the pattern transfer operation from the strip material 4 to the support strip 1, when the strip material 4 and the support strip 1 go through the transfer rollers 2, 3, as soon as strip materials 4, 4*a*, 4*b* going through the same reel 10 are not in gear with the embossing plates of tool 2 and of the counter roller 3, their speed can be modulated. The driving speed of rollers 10 is defined equal to the support strip speed, so that speeds of support strip 1 and of strip materials 4, 4*a*, 4*b* are the same. Because each of the strip materials 4, 4*a*, 4*b* is meant to transfer a specific pattern, which has a size and position on the support strip 1 that is different from those of another pattern, each strip material 4, 4*a*, 4*b* should be driven at a respective different time from another material strip. This is the reason why several intermittent driving disposals 9 are provided. Six are in the present illustrated example, but this number can vary more or less according to specific applications.

A storage disposal 15 is arranged between the transverse driving rollers 8, which continuously drive strip materials 4, 4*a*, 4*b* and the intermittent driving disposal 9 in order to allow the absorption of the lengths of the strip materials 4, 4*a*, 4*b* continuously coming out of the transverse driving roller (or rollers) 8 of these strip materials, while these strip materials are not driven by the intermittent driving disposal 9.

This storage disposal includes a storage housing 16 with an entrance 17 at the front to receive strip materials 4, 4*a*, 4*b* downstream of the driving rollers 8 and an exit 18 to bring these strip materials around the respective driving rollers 10. The back end of the storage housing 16 is linked to a vacuum source 19 meant to create a depression to form loops of variable length of strip materials 4, 4*a*, 4*b* inside of the storage housing 16 during interruption of the driving of the intermittent driving disposals. For each loop, two detectors 20, 20*a* allow respectively detecting the maximal and minimal loops formed by the strip material. When a new printing series is started on the rotary press, these detectors 20, 20*a* allow adjustment of the constant speed of the transverse supplying rollers 8, so that the loop formed by each strip material 4, 4*a*, 4*b* does not overstep the two limits. Once the theoretical constant speed of roller 8 is adjusted by means of detectors 20, 20*a*, it is slightly increased by a programmed order. The intermittent spools formed by strip materials 4, 4*a*, 4*b* will thus tend to grow. When detectors 20 receive a signal, they order a short rise of the corresponding press 8*a*, with the effect of slightly reducing the flow and thus shortening the affected loop. In order to improve the action of the system, all the upstream reversing rollers are subdivided in several adjacent parts, so that the strip materials 4, 4*a*, 4*b* are not linked with each other.

Figure 5:
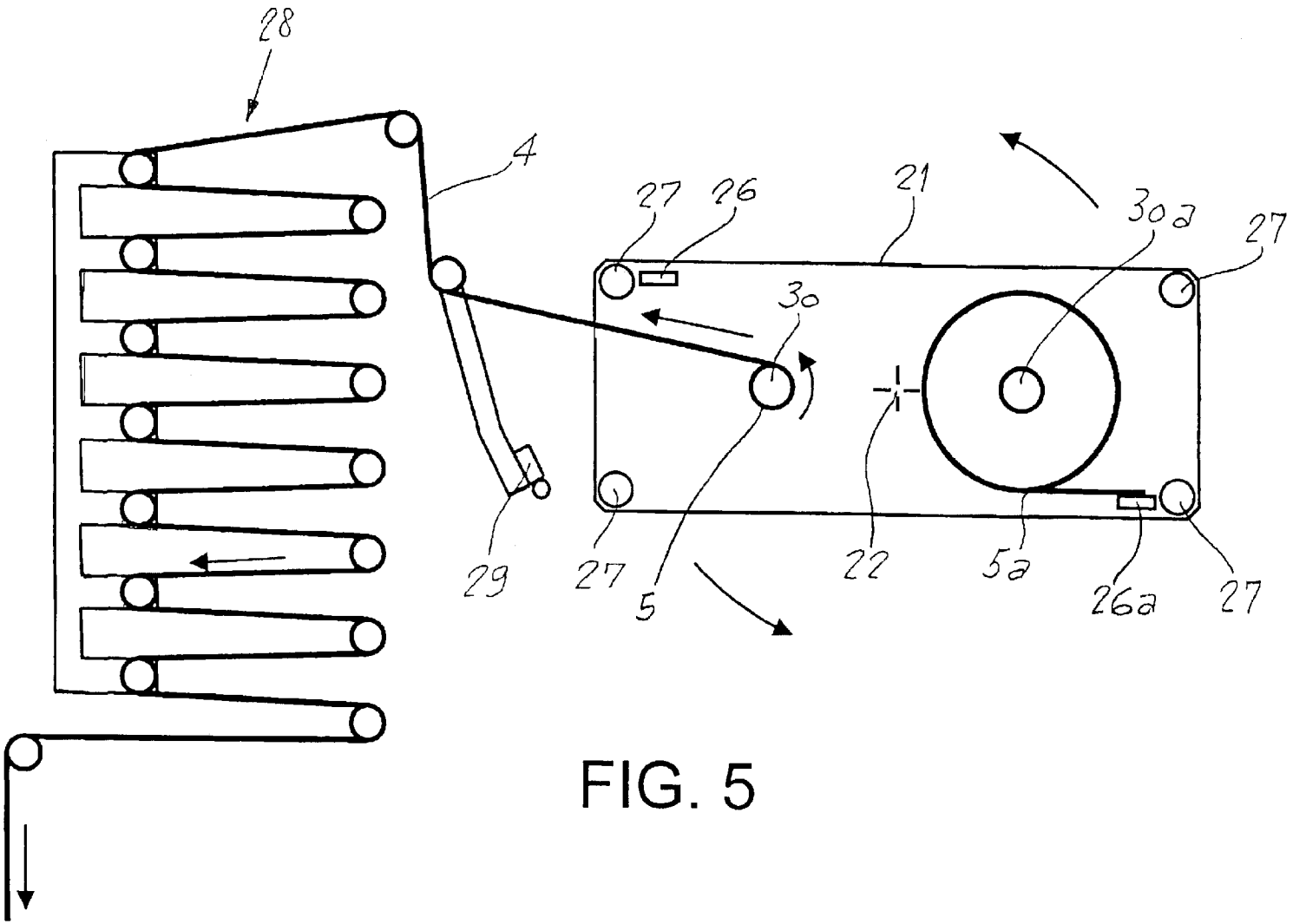
FIGS. 5 to 8 are simplified partial views of FIG. 1, showing the various stages of a junction operation between two material strips of patterns to be laid on the support strip.
Figure 8:
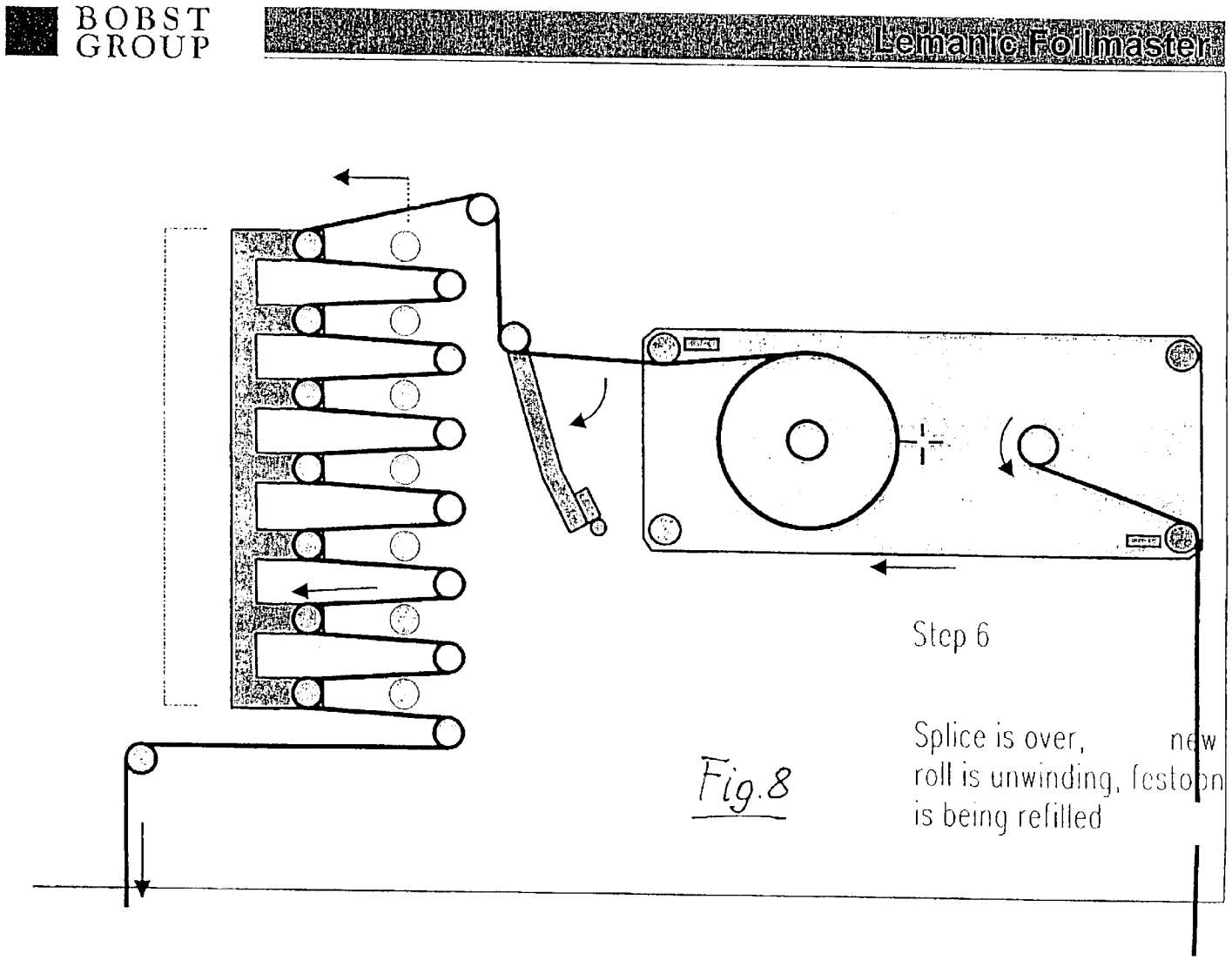

As shown in FIGS. 1, 5 and 8, each supplying unit 6, 6*a*, 6*b* includes a rectangular shaped reel support 21, mounted to pivot around a central axis 22. Each reel support 21 presents two pivot members 23, 23*a* to receive pivoting shafts 30, 30*a* of two supply reels 5, each alternately serving as a storage reel 5*a*, of strip materials 4, 4*a*, 4*b*. These pivot members 23, 23*a* respectively open on to opposite sides of the rectangular reels support 21, as shown in FIG. 1. Each pivot member 23, 23*a* is related to a respective locking lever 24, 24*a* to hold the pivoting axis of reels 5 and 5*a* when the pivot members 23, 23*a* opens at the bottom.

Preferably, for the joining between the two strip materials 4, 4*a*, 4*b* to be entirely automated, the central axis 22 of each reels support 21 is related to a generator 25 (FIG. 3) which turns the support 21 by 180° to replace an empty supply reel 5 by a reserve reel 5*a*. Each pivot member 23, 23*a* is also related to a backing piece 26, 26*a* for joining successive strip materials 4, 4*a*, 4*b*. Guides 27, comprised of rollers at the four angles or corners of the rectangular reels support 21, are used to seize strip materials 4, 4*a*, 4*b* in supplying progress, to make it pass at the periphery of the reels support 21, during the rotation of this reel support 21, when the supplying reel 5 has to be replaced by a reserve reel 5*a*.

As it can be noted, each half part of reel supports 21 lengthwise to the rectangle formed by this support 21 presents a symmetry with regards to the central pivoting axis 22 of this support 21, so that each half part of support 21 takes the place of the other half part of this support 21 when turned 180°. A junction member 29 is also provided in order to link the strip material at the end of reel 5 with the strip material at the beginning of the next reel 5*a*.

Before describing the running process of the junction system, it is useful to mention the presence, in each supplying unit, of a reserve disposal 28 for strip materials 4, 4*a*, 4*b*, which is arranged between the rectangular reels support and the transverse supplying rollers 8, in order to allow the constant supply of these strip materials 4 during the strip materials joining, during the time when the supply of strip materials 4, 4*a*, 4*b* is broken off in order to allow the connection between the strip material and the replacing reel 5.

Figure 6:
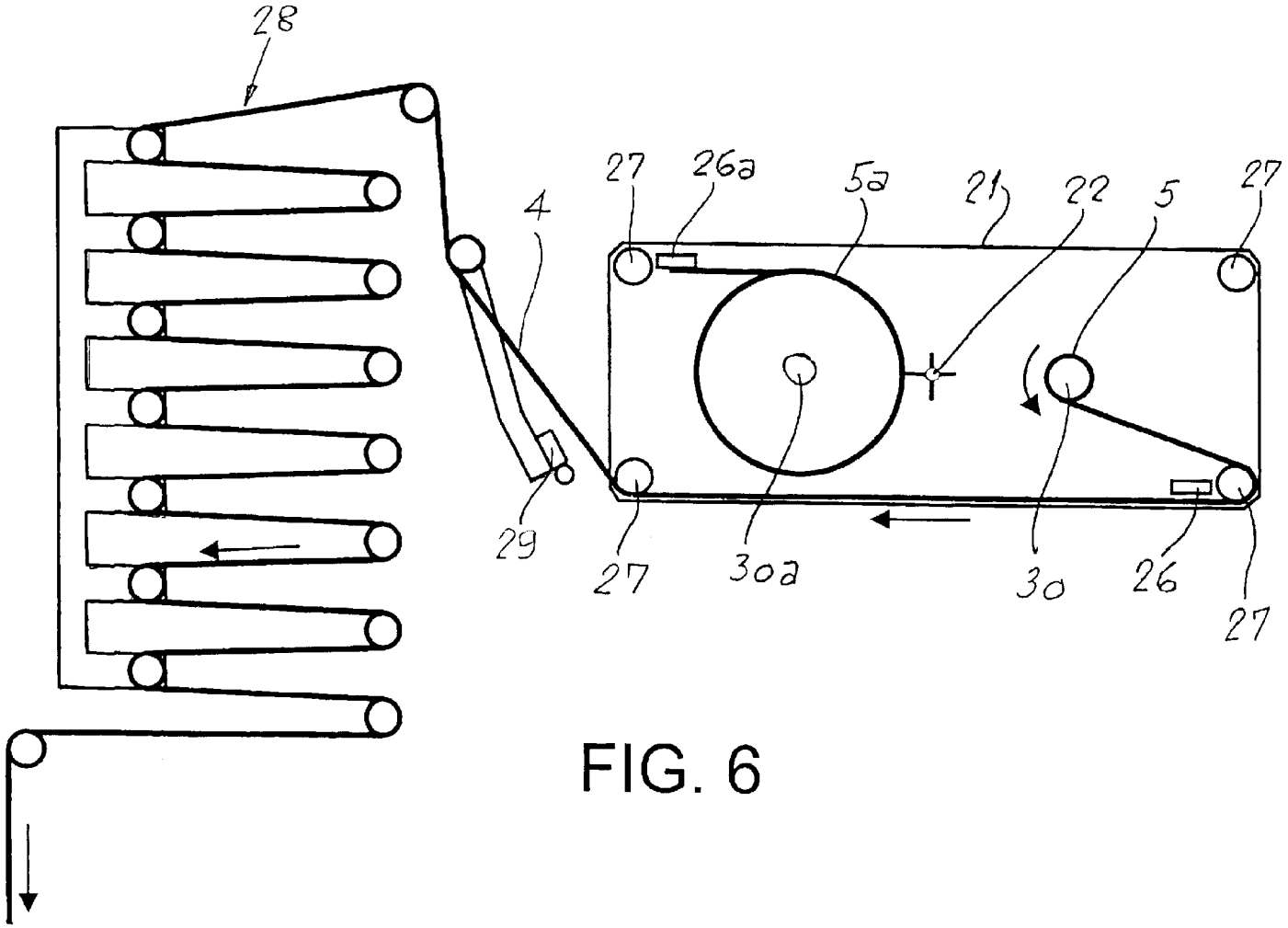
Figure 7:
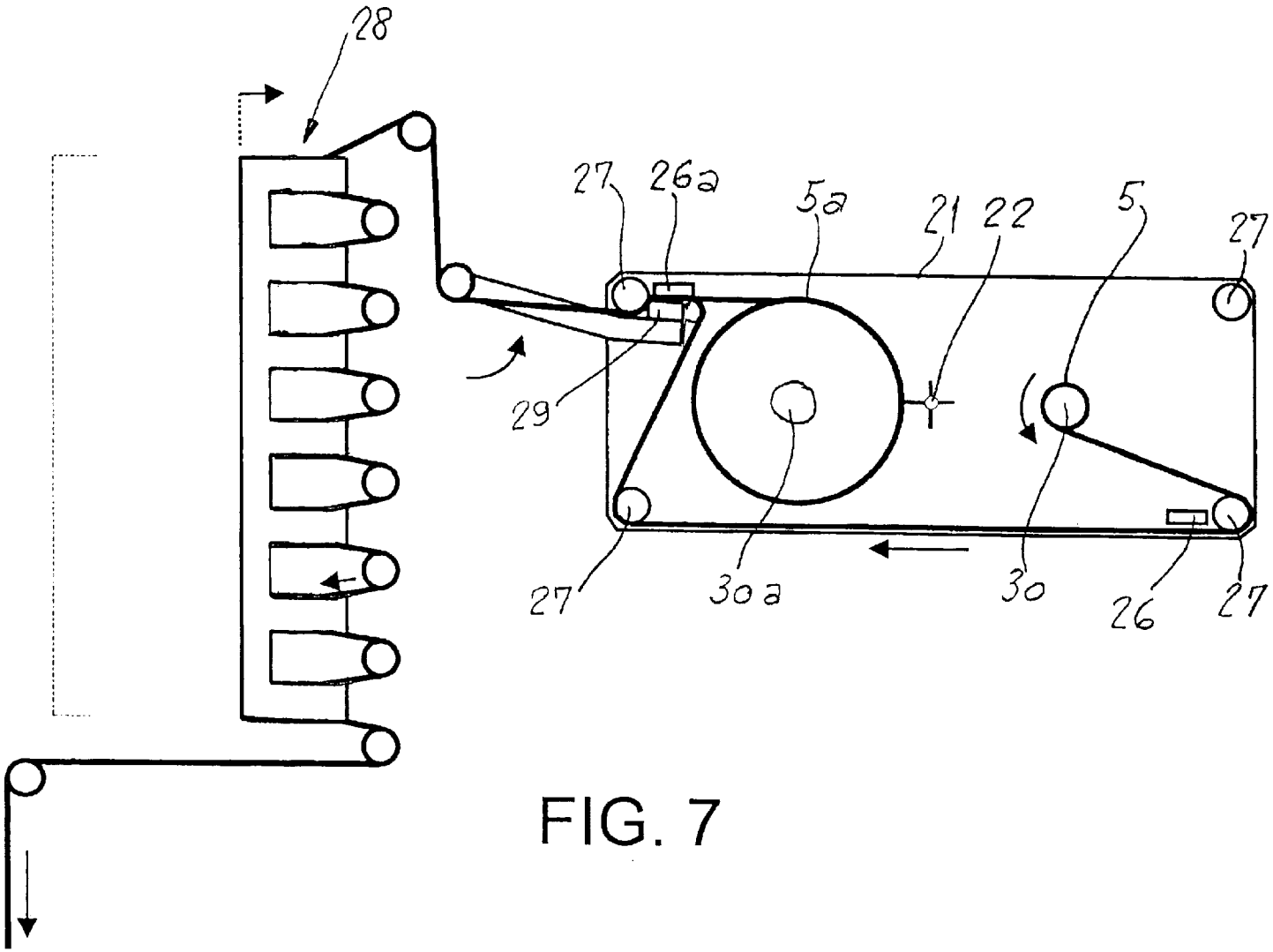

FIGS. 5 to 8 illustrate the various steps of the joining process for strip materials 4, 4*a*, 4*b* using simplified sketches. FIG. 5 shows the end of reel 5. FIG. 6 shows the reel support 21 after its 180° rotation anticlockwise. During this rotation, the strip material 4 is led by two reversing rollers 27. The upstream end of the new reserve reel 5*a* is ready for the joining operation. In FIG. 7, the joining member 29 presses the two strip materials 4, 4*a*, 4*b* in order to squeeze them against the backing piece 26 in order to stick them to each other. During this sticking operation, strip materials 4, 4*a*, 4*b* are temporarily immobilized. At that time, the piled up strip material in the reserve disposal 28 is emptied in order to allow the transverse supply rollers to continuously supply the rotary press with strip materials 4, 4*a*, 4*b* to be printed on the support strip 1.

Then, cutting means (not represented), which can be related to the junction member 29, cut the remaining strip material of reel 5, and the junction member 29 returns to its inactive position as illustrated by FIG. 8, so that the new supply reel, which has been the reserve reel until then, begin to supply the rotary press. At first, the reserve disposal 28 stocks up again for the next reel change. It is meanwhile necessary to replace the empty reel 5 by a new full reserve reel 5*a*. This operation, which is performed manually, is easy due to the lateral location of the supply disposal of the rotary press that facilitates access to the reels support 21 and particularly to the pivot members 23, 23*a* of supply reel 5 and of reserve reel 5*a* on reels support 21, particularly as the pivot members 23, 23*a*, on which stands the supply reel 5 to be changed, jut out over the supply unit 6, 6*a*, 6*b*, as shown in FIG. 1.

Another storage disposal 15*a* is located downstream of working station 2, 3. It is related to a traction group with an exit 50, equipped with pressers 50*a*, which are adjusted laterally to be positioned on strip materials 4, 4*a*, 4*b*, etc. Now, these strip materials can arise from several stages (6, 6*a*, 6*b* of FIG. 1) and thus may have different average speeds. It should be observed that group 50, 50*a* turn at a constant speed, more precisely at the fastest speed of the fastest group of traction 8. To obtain a lower average speed flow, corresponding to a group 8 with reduced flow, the related pressers 50*a* are lifted up periodically. They thus block the associated strip 4. Strips 4, the flow of which is to be reduced, execute then a stop/start movement. The activation/deactivation of pressers 50*a* can be done directly by the loops control in the storage disposal 15*a*, or by calculating a regular basic cycle and superimposing possible corrections, derived from the individual loops supervision in the storage disposal 15*a*. As another solution, it possible to install a supplementary group 50, 50*a* that would adopt a specific average speed.

Figure 9:
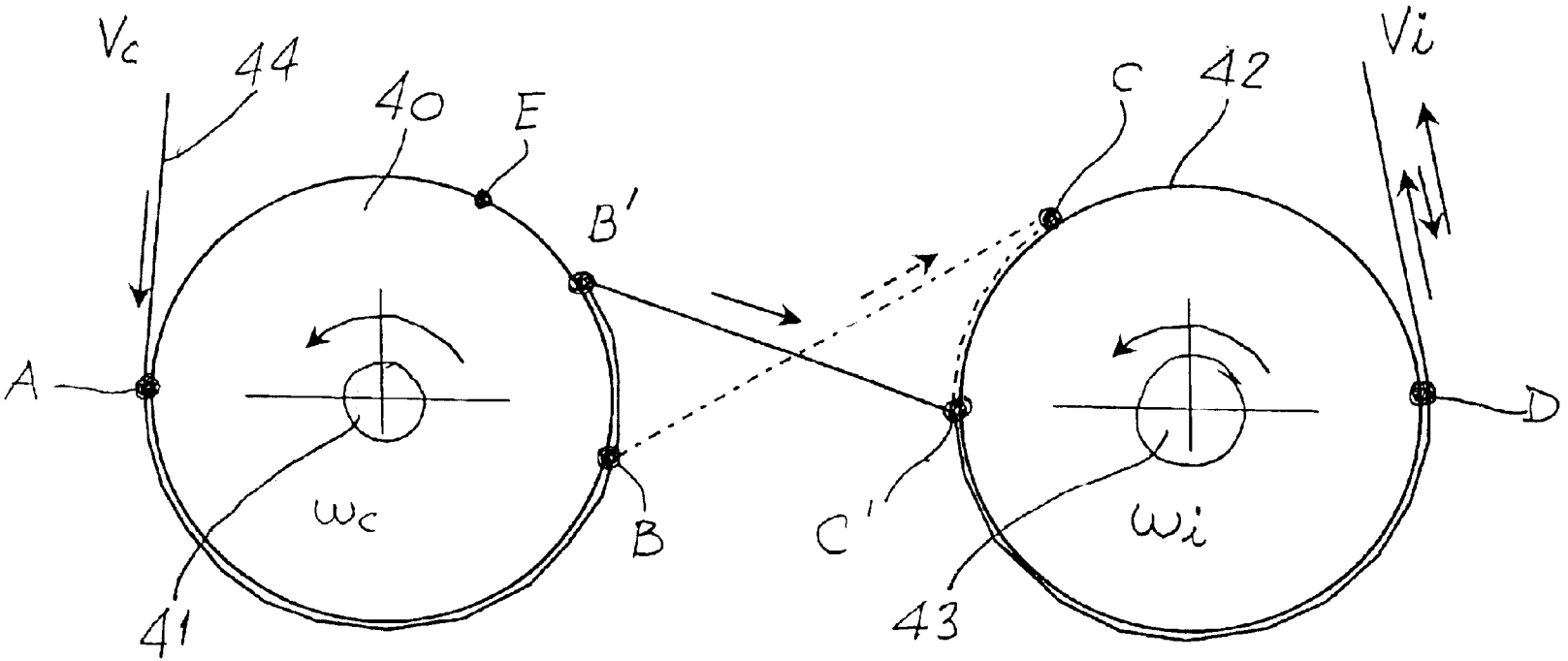
FIG. 9 represents an alternative execution of a modulation gear of the strip material speed.

FIG. 9 represents a different execution of a modulation member at the strip speed by replacing elements 8, 15, and 10, 11 of FIG. 4. Indeed, it can be advantageous to have a second execution, to create for example, a compact stamping unit to be inserted into the device. The aim is to create a speed modulation for at least one metallic strip 44. This one passes through a first roller 40, linked to an appropriate generator with a vacuum 41 and unassembled means but known to selectively bring the vacuum to the cylinder periphery between generators A and E going through B. Strip 44 is driven at a constant speed vc by roller 40, which roller has a rotation speed wc which is constant and defined according to the average required consumption. Strip 44 goes through generator A, a point between B and B', a point between C and C', D and leaves the device with a speed vi. Roller 43 is mounted like roller 40, with only one difference in wi, the rotation speed, modulated to save strips as described above referring to FIGS. 2 and 4. The average flow induced by the intermittent rotation wi of roller 42 is similar to the flow provided by roller 40. We easily understand path BC to be real only at one moment of the cycle. Separation point B and junction point C move on the surfaces in step with wi's profile. The extremely low mass of strip 44 helps to create a path and a modulation speed vi perfectly under control along the cycles. There is neither slippage between 44 and 40, nor between 44 and 42; vacuums 41 and/or 43 could thus be replaced by a presser or an external pressure. Speed wc can be influenced by a path control between roller 40 and 42. If points B and C tend to go down, this can be intercepted by means such as photocell (not represented) that will slightly increase speed wc. The opposite action can be realized by a similar means mounted above B,C. Thus the software is free to superimpose corrections to the position of roller 42, in the holograms printing for example. A special modulation can also be tolerated and can turn out to be very useful to pass a connection of strip 44 out of the gear of embossing plate 16, for example.

Although the present invention has been described in relation to particular embodiments thereof, many other variations and modifications and other uses will become apparent to those skilled in the art. It is preferred, therefore, that the present invention be limited not by the specific disclosure herein, but only by the appended claims.

What is claimed is:

1. A rotary press for printing patterns on a support strip comprising:

a driveable support to drive the support strip lengthwise at a selected speed;

a supply for supplying at least one strip material with a pattern thereon; the supply for the strip material is arranged laterally of the support strip and laterally of the lengthwise drive direction of the support strip;

a transfer device shaped and positioned for bringing the support strip and the strip material together and for transferring patterns to the support strip at defined locations;

an intermittent drive operable on the strip material for driving the strip material through the transfer device intermittently and at the speed of the support strip; the intermittent drive being operable for driving the strip material from the supply in a direction transverse to the lengthwise direction of the support strip; and strip material redirection devices positioned after the supply for modifying the direction of the material strip after the material strip leaves the supply and before the material strip passes to the transfer device, from a supply direction transverse to the lengthwise drive direction of the support strip to a transfer direction of the patterns that is parallel to the lengthwise drive direction of the support strip.

2. The press of claim 1, wherein the supply of at least one strip material includes a constant drive for driving the strip material at a constant speed;

a storage disposal for strip material arranged between the constant drive for the strip material and the intermittent drive for the strip material wherein the storage disposal stores strip material before it is driven by the intermittent drive.

3. The press of claim 2, wherein the intermittent drive of the strip material includes a drive roller which contacts the strip material after the strip material has passed the storage disposal;

a free rotation roller engageable with the drive roller so that the drive roller and the rotation roller together move the strip material; and a contact device for selectively applying the free roller against the drive roller so that the strip material is pinched between the drive roller and the free rotation roller and driven by the rollers, and for moving the free rotation roller off the driving roller and halting the driving.

4. The press of claim 3, wherein a profile of intermittent speed of the intermittent drive is obtained and operable through a combination of first and second rollers wherein one of the rollers is run at a constant speed wc and the other roller is run at an intermittent speed wi.

5. The press of claim 4, in which strips are maintained without friction over the roller surfaces by a vacuum.

6. The press of claim 2, wherein the storage disposal of the strip materials includes a storage housing storing reserve parts of the strip materials, the storage housing having an entry for the strip material which has come from the strip supply and having an exit for the strip material to the intermittent drive for the strip material;

a loop creator associated with the storage housing comprising detectors to detect maximum and minimum storage limit positions of the strip material inside the storage housing.

7. The press of claim 2, wherein the constant drive for the strip material are downstream of the redirection devices for maintaining a constant tight portion of the strip material passing through the redirection devices.

8. The press of claim 2, wherein the redirection devices comprise linear driving member arranged on a bisectrix of the angle formed by the supply direction of the strip material and the lengthwise drive direction of the support strip for enabling the lengthwise direction of the strip material to form a 90 degree angle between its parts located upstream and downstream of the linear drive member, after the 180 degree rotation of the material strip around a linear drive member.

9. The press of claim 1, wherein the supply of strip material includes a plurality of independent ones of the supplies of strip material, and the independent supplies are superimposed and positioned for providing strip material to the support strip.

10. The press of claim 1, further comprising a constant drive operable on the strip material for receiving the strip material from the supply and for driving the strip material at a constant speed;

the strip material being in lengths with trailing and starting ends;

a junction device for connecting the trailing end of a length of the strip material to the starting end of another length of the strip material.

11. The press of claim 10, further comprising a reserve for a section of the strip material located between the junction device and the constant drive to hold strip material, thereby enabling a constant supply of the strip material to be made available during a joining operation performed by the junction device.

12. The press of claim 10, wherein the constant drive includes a plurality of the press rolls, each press roll for engaging the respective one of the strip materials and a presser at each of the press rolls which is adapted for being intermittently raised allowing variation of the strip material flow on the respective drive and allowing storage by adjustment of a position of a loop of the strip in the loop storage; and an automatic feedback loop arrangement for controlling a variation of the strip flow to provide an average position of a strip loop in the storage.

13. The press of claim 12, further comprising breaker rollers upstream of the constant drive, the breaker rollers being subdivided in a plurality of adjacent parts for disconnecting neighboring strip materials from each other for defining a plurality of the strip materials.

14. The press of claim 10, wherein the junction device includes a junction device support for a first supply reel and for a second reserve reel, each reel is for supplying strip materials;

a pivot axis for the junction device support, such that pivoting of the junction device support around the pivot axis moves the supply reels toward and away from a position where one of the reels can supply strip material;

pivotable means on the junction device support for receiving the supply reels, the pivotable means being parallel and symmetric to the pivot axis of the junction device support;

guides and support members in the junction device support for the strip material and related to each of the supply reels, the guides and the support members being disposed symmetrically in the junction device support with reference to the pivot axis thereof;

a rotation drive for the junction device support for rotating the junction device support around the respective pivot axis by 180 degree steps;

a junction forming device for applying the trailing part of a length of the strip material of one reel against an initial part of a length of the strip material of the other reel and for applying the ends against the junction device support to form the junction between the adjacent ends of the strip material on successive reels.

15. The press of claim 1, further comprising an additional storage disposal for outgoing strip materials after passing the transfer device and a pulling device for pulling the strips through the additional storage disposal, the additional storage disposal being shaped and positioned for a loop of the outgoing strip to be formed there and the pulling device having a speed that is adjustable with respect to the average position of the loop of the strips in the additional storage disposal.

16. The press of claim 15, wherein the pulling devices are divided into two pulling devices and each is related to a respective drive for the strip material at a constant speed at almost the same speed.

17. The press of claim 15, further comprising operating software for the pressers for the defined speed drive and for the pulling devices and it is the same software, and wherein prior to the storage disposals (check above) are identical.

18. The press of claim 15, wherein the pulling devices are operable so that related strip materials are locked in step by rhythm given by a control system of the loops in the associated storage disposal for the strip.

19. The press of claim 18, wherein the constant speed wc is adjusted by control means located over and under a zone extending between the rollers.

* * * * *